US005420825A

United States Patent [19]

Fischer et al.

[11] Patent Number: 5,420,825

[45] Date of Patent: May 30, 1995

[54] NOISE CONTROL COMPOSITE

[75] Inventors: Eugene C. Fischer, Arnold; Jean A. Montemarano, Annapolis; Vincent J. Castelli, Severna Park; Joseph W. Dickey, Annapolis, all of Md.

[73] Assignee: The United States of America as represented by the Secretary of the Navy, Washington, D.C.

[21] Appl. No.: 413,952

[22] Filed: Aug. 31, 1982

[51] Int. Cl.[6] ..... H04K 3/00

[52] U.S. Cl. ..... 367/1

[58] Field of Search ..... 310/800; 367/157, 162, 367/165, 173, 901, 1

[56] References Cited

U.S. PATENT DOCUMENTS 3,971,250 7/1976 Taylor ..... 310/800

4,158,189 6/1979 Wardle ..... 367/153

4,184,093 1/1980 Sullivan ..... 310/800

4,236,235 11/1980 Gilbert ..... 367/157

4,295,010 10/1981 Murphy ..... 310/800

*Primary Examiner*—Daniel T. Pihulic

*Attorney, Agent, or Firm*—Luther A. Marsh; Charles D. Miller

[57] ABSTRACT

A composite for use on submarines and surface craft for controlling self-generated noise when listening with sonar. The composite includes two layers of $PVF_2$ transducers separated by a layer of phase shifting or absorbing material. The inner transducer senses noise from the ship and subtracts this from the signal from the outer transducer representing noise plus the desired signal. In a second mode the sensed noise is regenerated through the outer transducer 180° out of phase to cancel the noise and allow more accurate detection.

10 Claims, 1 Drawing Sheet

NOISE CONTROL COMPOSITE

FIELD OF THE INVENTION

This invention relates to an acoustical composite material and more particularly to a noise control composite material for use on a sonar array of a ship.

DESCRIPTION OF THE PRIOR ART

Shipboard noise is a problem for military ships when trying to locate the enemy. When using sonar apparatus to listen for other ships, the listening ship's own generated noise may make detection of the enemy difficult. Machinery on board may give off enough noise to mask any noise from the ship to be detected. Since it is not always possible to shut down the offending machine, the task of hearing the enemy ship becomes difficult.

Currently, noise control technology is limited to either electronically filtering the frequency of the historical self-noise or applying appropriate damping materials to reduce self-noise. In the former case, the sonar operator limits his ability to listen to the frequency range so removed. In the latter case, the damping material and the labor involved in applying it are expensive and are limited to particular types of noise sources or frequency ranges. Further, conventional sonar is frequency limited due to overall size compatibility with the hull structure and also is directionally limited.

The sonar array shown in U.S. Pat. No. 4,158,189 is a conformal blanket sonar array covering a large, portion of the hull of a submarine. The large area covered decreases the size incompatibility with the hull structure. In addition, this device is designed to avoid self-noise by separating the sensor from the external surface by a large thickness of elastomer. However, the problem of directionality is not approached and this damping structure has disadvantages already noted.

The use of polyvinylidene fluoride as a piezoelectric device for a hydrophone is shown in U.S. Pat. No. 4,236,235. However, only a single layer is shown and there is no attempt to control noise.

SUMMARY OF THE INVENTION

Accordingly, one object of this invention is to provide a composite material for a sonar array having noise control.

Another object of this invention is to provide a composite material with at least two piezoelectric layers, all but one of which is always passive and one of which may be active or passive.

A further object of this invention is to provide a sonar array which is neither frequency nor directionally limited.

A still further object of the invention is to provide a sonar array which may cancel current self-noise as it is being measured.

Briefly, these and other objects of the invention are achieved by providing a multi-layered composite material including at least two piezoelectric layers separated by phase shifting or absorbing layers. Insulator layers are provided as required between the piezoelectric layers and both the hull and the water. Any of the piezoelectric layers may be driven to cancel out self-noise sensed by any of the other piezoelectric layer(s) or a difference may be taken electronically between the signal sensed by any of the layers.

BRIEF DESCRIPTION OF THE DRAWINGS

A more complete appreciation of the invention and many of the attendant features thereof will be readily appreciated as the same becomes better understood by reference to the following detailed description when considered in connection with the accompanying drawings wherein.

DETAILED DESCRIPTION OF THE DRAWINGS

Figure 1:
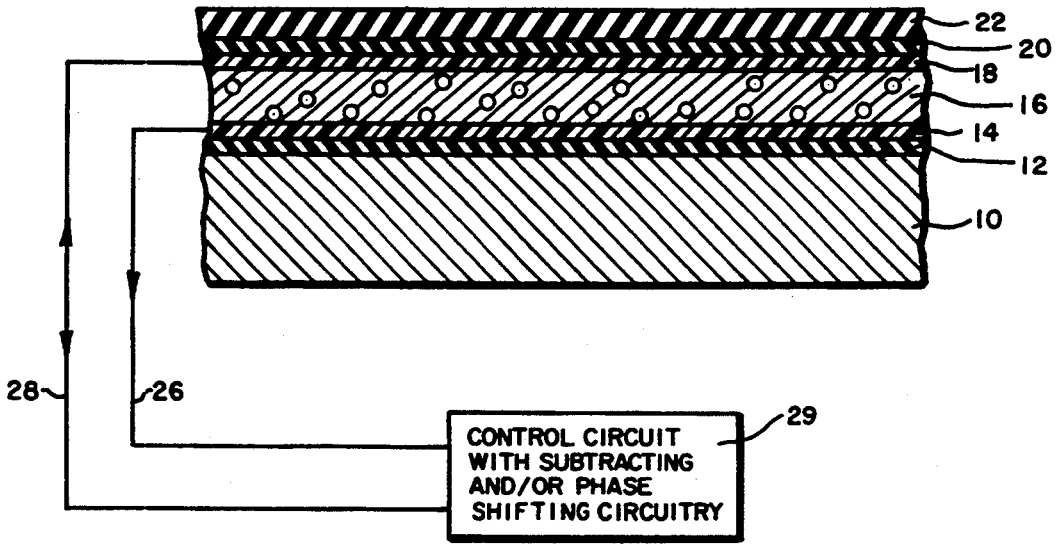
FIG. 1 is a cross-sectional view of the piezoelectric layer composite material of the present invention.

Referring now to the drawings wherein like reference characters designate identical or corresponding parts throughout the views and more particularly to FIG. 1 where the overall arrangement of the various layers of the composite material are shown as being supported by the hull structure 10 of a ship or submarine. A neoprene insulator layer 12 is formed on top of the hull to serve as an electrical isolation and adhesion layer. An inner piezoelectrical layer 14 acts as a sensor for detecting sound that passes through the insulating layer. Line 26 carries the signal from the layer to an electronic control device 29, which is described in further detail below. A layer of phase shifting or insulating material 16 is placed outside the inner sensor layer 14 and inside an outer piezoelectric sensing layer 18. The outer sensor layer may act as a sound detector for sound from outside the ship in the passive mode or may be driven to produce sound in the active mode. Line 28 connects the layer to the electronic control device 29 and insulating elastomeric layer 20 on top of the outer sensor layer serves as the protective layer and completes the composite structure. Another protective elastomeric layer 22 may contain antifoulant material such as organometallic polymers to prevent marine growth, or layer 20 could itself be formed of antifouling rubber.

When operating the sonar listening device it is desirable to cancel out from the detected signal all noise that eminates from within the ship. This is accomplished in the present invention by sensing the noise-related electrical signals on the various sensitive layers in two ways. The first way takes advantage of the sound absorption of layer 16 and uses the difference in signals on the inner and outer sensors, thus indicating whether the source of noise was inside or outside the ship's hull. The two detected signals are fed to an electronic control circuit by way of leads 26 and 28. The circuit may subtract the signal of the inner sensor from the signal of the outer sensor to effectively cancel out the noise from the ship and listen solely to external sound. If necessary, one or both of the two signals may be amplified so that the amplitude of the noise is the same in each signal and exact cancellation is achieved.

A variation in the method of differentiating incoming from outgoing noise is by examining the phase difference between the signals sensed by the inside and outside sensors. In all cases where the wavelength of the signal in the absorbing layer 16 is long compared with the thickness of the layer, the phase shift will indicate the direction of travel of the signal. For example, if the acoustic signal is coming from the outside to the inside, then the signal on the outside sensor will lead the inside by an amount determined by the thickness and sound speed of layer 16.

In another mode of canceling noise, the outer sensor is used actively. The signal from the inner sensor representing mostly internal noise is processed by the control circuit to produce a signal 180° out of phase with the original. This processed signal is used to drive the outer sensor so that the sound from the outer transducer is 180° out of phase with the noise from the ship. This results in a physical cancellation of the noise from the ship, allowing the sensor to detect the signal from outside the ship more distinctly without interference from shipboard noise. Thus, the sensor cancels out noise while listening for other craft.

While the transducers are preferably $PVF_2$ (polyvinylidene fluoride) sheets, due to its flexibility and cost, it is also possible to use other transducers such as piezoelectric polymers and ceramics. Similarly, the insulating layers may be neoprene or other elastomers, or even harder polymers. Layer 16 may be a suitable anechoic material which acoustically and electrically insulates the piezoelectric material and phase shifts the signals between the two transducer layers. The outer antifoulant layer is not necessary for the operation of the sonar array but provides antifouling protection and maintenance of physical protection and integrity.

Figure 2:
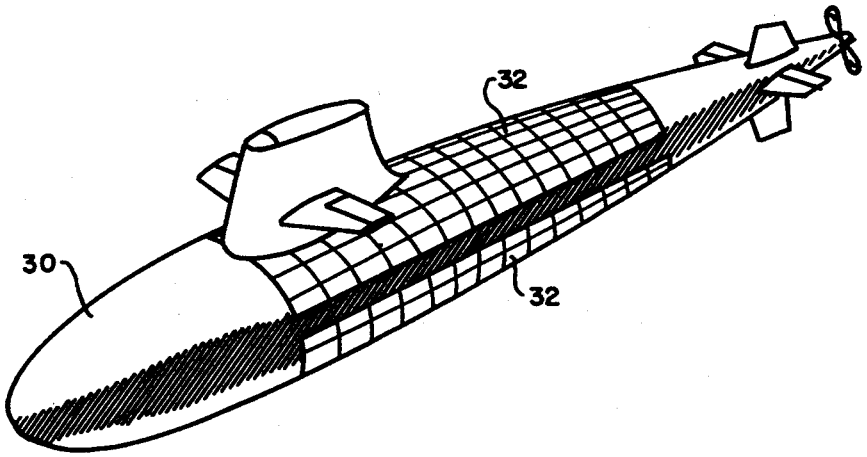
FIG. 2 is a perspective view of a sonar array according to the present invention.

As shown in FIG. 2, the composite material may be formed into individual tiles which are placed in desired areas on the hull of the ship. These areas may be near sources of noise such as heavy machinery in order to provide the greatest quieting effect. The tiles also may be placed in various patterns over large areas of the hull in order to form sonar arrays in desired directional patterns. In addition, since each tile is electrically connected to a central control device, it is possible to cover a large area of the hull with tiles without regard to any pattern, and merely turn on and off various tiles by means of the central control to form a required directional pattern. Patterns may be quickly shifted by the central control in order to sense sound in various directions, allowing the operator to better pinpoint the direction from which the sound comes. Thus, the operator is not limited to listening to a few directions determined in advance by the arrangement of tiles, but may select almost any direction electronically. Also it is possible to actuate tiles only in noisy areas where noise canceling is most needed.

In addition, it is possible to use part of the sensors in the active mode, and part in the passive mode at the same time. Central electronic control allows convenient switching both as to mode and as to directional pattern. Since the response of the sensors in different modes may be different, it may be advantageous to use one mode over noisy areas and the other mode over quieter areas.

The control device 29 may take many forms. It is possible to use a general purpose computer or a microprocessor which may be programmed to handle the switching functions. A simple manually operated device could contain a subtracting circuit and a phase reversal circuit with a mode selection switch to change the input to the two circuits.

In addition, each tile could be represented by an on-off switch to select the array desired. Such a manual device would be easily constructed and simple to operate.

Obviously, many modifications and variations of the present invention are possible in light of the above teachings. It is, therefore, to be understood that within the scope of the appended claims the invention may be practiced otherwise than as specifically described.

What is claimed is:

1. A composite material for use in a sonar device comprising:

a first neoprene accoustic insulator layer placed on a solid substrate;

a plurality of layers including alternating transducer layers and sound absorbing layers;

a second neoprene accoustic insulator layer on top of said plurality of layers; and an antifouling layer including an elastomeric rubber containing an organometallic polymer.

2. A composite material for use in a shipborad sonar device comprising:

at least one first transducer layer;

at least one second transducer layer outside of said first transducer layer;

at least one layer of anechoic material between said first and second transducer layers for accoustically insulating said first and second transducer layers from each other;

at least one first lead, each of said first leads being connected to one of said first transducer layers;

at least one second lead, each of said second leads being connected to one of said second transducer layers; and a control circuit connected to said first and second leads for receiving signals from said first and second transducer layers and for processing said signals so as to cancel shipboard noise from an output signal.

3. A composite material according to claim 2 further comprising a first insulating layer-between said first transducer layers and said ship; and a second insulating layer between said second transducing layers and the sea.

4. A composite material according to claim 2 wherein said control circuit includes a subtraction circuit connected to said first and second leads for subtracting the signal on said first leads from the signal on said second leads to produce an output signal free from noise.

5. A composite material according to claim 2 wherein said control circuit includes a phase shifting circuit connected to said first and second leads for receiving the signal from said first leads and sending a phase shifted signal on said second leads to produce an output signal free from noise.

6. A sonar device for a ship comprising:

a plurality of tiles each producing a signal, arranged in an array, wherein each tile is made of a layered composite material including at least two transducer layers separated by a layer of accoustical absorbing material; and a control circuit for selectively activating some of the tiles in the array to achieve directionality and for canceling self-generated noise from said signal.

7. A sonar device according to claim 6 wherein said control circuit includes a subtraction circuit for subtracting the signal from one of said transducer layers from the signal from the other transducing layer to cancel noise from the output signal.

8. A sonar device according to claim 6 wherein said control circuit includes a phase shifting circuit for receiving a signal from one of said transducer layers and sending a phase shifted signal to the other transducer layer to produce an output signal free from noise.

9. A composite material according to claim 2 wherein said control circuit includes means for amplifying and phase shifting signals connected to said first and second leads for receiving the signal from said second leads and sending an amplified, phase shifted signal on said first leads to produce an output signal which cancels incoming noise.

10. A composite material according to claim 2 wherein said control circuit includes means for amplifying and phase shifting signals connected to said first and second leads for receiving the signal from said first leads and sending an amplified, phase shifted signal on said second leads to produce an output signal which cancels outgoing noise.

* * * * *